US008177197B1

(12) United States Patent
Ergican

(10) Patent No.: US 8,177,197 B1
(45) Date of Patent: May 15, 2012

(54) CONTINUOUS CARBONATION APPARATUS AND METHOD

(75) Inventor: Erdogan Ergican, Torrance, CA (US)

(73) Assignee: Natura Water, Inc., Saddlebrook, NJ (US)

( * ) Notice: Subject to any disclaimer, the term of this patent is extended or adjusted under 35 U.S.C. 154(b) by 347 days.

(21) Appl. No.: 12/432,236

(22) Filed: Apr. 29, 2009

(51) Int. Cl.
*B01F 3/04* (2006.01)

(52) U.S. Cl. ..... 261/78.2; 261/116; 261/DIG. 7; 366/341

(58) Field of Classification Search ..... 261/78.2, 261/79.2, 111, 116, DIG. 7; 366/341
See application file for complete search history.

(56) References Cited

U.S. PATENT DOCUMENTS

| | | | | |
|---|---|---|---|---|
| 3,560,228 | A * | 2/1971 | Engel | 426/474 |
| 3,749,378 | A * | 7/1973 | Rhodes | 261/78.2 |
| 3,761,066 | A * | 9/1973 | Wheeler | 261/78.2 |
| 3,927,868 | A * | 12/1975 | Moore | 206/221 |
| 3,941,355 | A * | 3/1976 | Simpson | 366/99 |
| 4,370,304 | A * | 1/1983 | Hendriks et al. | 422/224 |
| 4,629,589 | A | 12/1986 | Gupta et al. | |
| 4,869,849 | A * | 9/1989 | Hirose et al. | 261/78.2 |
| 4,950,431 | A | 8/1990 | Rudick et al. | |
| 5,152,935 | A | 10/1992 | Robertson | |
| 5,792,391 | A | 8/1998 | Vogel et al. | |
| 5,842,600 | A | 12/1998 | Singleterry et al. | |
| 5,958,307 | A | 9/1999 | Kazuma | |
| 6,060,092 | A | 5/2000 | Oesterwind et al. | |
| 6,280,615 | B1 * | 8/2001 | Phillips et al. | 210/198.1 |
| 6,758,462 | B2 | 7/2004 | Bellas et al. | |
| 6,767,009 | B2 | 7/2004 | Ziesel | |
| 6,848,600 | B1 | 2/2005 | Crisp, III | |
| 7,267,247 | B1 | 9/2007 | Crunkleton, III et al. | |
| 7,318,581 | B2 | 1/2008 | Robards, Jr. et al. | |
| 7,547,002 | B2 * | 6/2009 | Mao et al. | 261/78.1 |
| 2008/0105989 | A1 | 5/2008 | Rona et al. | |

* cited by examiner

*Primary Examiner* — Charles Bushey
(74) *Attorney, Agent, or Firm* — Standley Group LLP

(57) ABSTRACT

The present invention provides a method and compact apparatus for providing a continuous flow of carbonated water. The apparatus atomizes the water into microscopic particles allowing for significantly increased interaction between the water and the carbon dioxide. The water and the carbon dioxide then travel into a mixing chamber where further mixing takes place. The invention does not require the use of a pump or the use of a large carbonator vessel.

14 Claims, 5 Drawing Sheets

CONTINUOUS CARBONATION APPARATUS AND METHOD

CROSS-REFERENCE TO RELATED APPLICATIONS

This non-provisional patent application makes no claim of priority to any earlier filings.

TECHNICAL FIELD

The disclosed embodiments of the present invention are in the field of gas dissolution, and relate more particularly to the field of water carbonation.

BACKGROUND OF THE ART

Apparatus and methods for mixing gases and liquids and, more particularly, apparatuses for dissolving carbon dioxide in water to produce carbonated water, are well known. The quality of carbonated water depends primarily upon the thoroughness with which carbon dioxide is dissolved in the water.

Conventional systems to produce carbonated water use two basic principles. Namely, pressurized carbon dioxide is introduced into a standing volume of water to be carbonated while in a storage tank, or pressurized water is introduced into a tank with a carbon dioxide atmosphere. In either case, the carbonated water produced is stored in the tank until withdrawn. Generally these systems employ valves, pressure gauges and other complex devices in order to maintain adequate pressure in the storage tank.

It can be appreciated that if gaseous carbon dioxide and water are brought into contact with one another and mixed extensively over a long period of time in a large carbonating apparatus, where mixing of the carbon dioxide and water can be repeated until an optimal concentration is achieved, high-quality carbonated water will be obtained. However, the production of high-quality carbonated water becomes more problematic when time and space constraints are imposed on the carbonation apparatus, as is the case with, for example, restaurant beverage vending or in-home carbonated water dispensers.

Many issues are encountered with small scale carbonating apparatus. These range from problems regulating liquid and gas flow rates to spitting and sputtering which occurs upon initial operation due to a build up of pressure caused in part by the separation of gas and liquid upon standing for a period of time. Conventional systems that produce carbonated water suffer from several critical problems. Generally, those are expense, size, and complexity of the apparatus. All three of these problems need to be addressed in order to more effectively meet the in-home and small scale business application demand for carbonation apparatus.

Conventional carbonators often are bulky and have several valves and other components protruding from the carbonating tank (also called the carbonator). Additionally, conventional water carbonation apparatuses utilize large carbonating tanks for more efficient dispensing, because the carbonated water often needs to be stored under pressure after mixing in order that the carbonated water could be accessible on demand. Thus, it was impracticable to have only a small amount of carbonated water stored in the chamber, and large carbonating chambers became the norm. However, this large size and its corresponding footprint are undesirable.

Many conventional carbonation apparatuses employ a large tank for storing the carbonated water. As stated above, the apparatuses often use a large carbonator out of efficiency and a desire to have a large quantity of carbonated water on demand if needed. However, drawbacks of using a large storage vessel are numerous. Large carbonator vessels need to be pressurized or the carbonated water that is being stored will lack optimal carbonation. Likewise, carbonator vessels often need to be cooled, the cooling serves to keep the carbonated water at a pleasant temperature for drinking, but is often necessary to keep the beverage carbonated. Additionally, large storage containers will often need some automated mixing apparatuses, also aimed at maintaining or improving the concentration of carbonation in the carbonated water. Furthermore, all of these drawbacks increase the size, complexity and cost of carbonated water production. These drawbacks can be eliminated if the need to store the produced carbonated water is eliminated. Thus, the development of an instantaneous and continuous water carbonation device is desirable.

The embodiments described in this application are directed at a smaller, more streamlined, continuous source of carbonated water.

SUMMARY OF THE INVENTION

It is widely appreciated that greater efficiency in dissolving one substance in another may be had where both substances have a high degree of surface area with which to interact. In the arena of water carbonation this is often achieved by introducing a diffuse stream of carbon dioxide into water where the carbon dioxide stream flows through a plurality of very small filaments, thus introducing many streams of very small carbon dioxide bubbles into the water.

The disclosed embodiments provide a method and compact apparatus for providing a continuous flow of carbonated water. The apparatus atomizes the water into microscopic particles allowing for significantly increased interaction between the water and the carbon dioxide. The water and the carbon dioxide then travel into a mixing chamber where further mixing takes place. The disclosed embodiments do not require the use of a pump or the use of a large carbonator vessel.

This and other unmet needs of the prior art are met by a device as described in more detail below.

BRIEF DESCRIPTION OF THE DRAWINGS

A better understanding of the illustrated embodiments will be had when reference is made to the accompanying drawings, wherein identical parts are identified with identical reference numerals, and wherein.

DETAILED DESCRIPTION OF A PREFERRED EMBODIMENT

Figure 1:
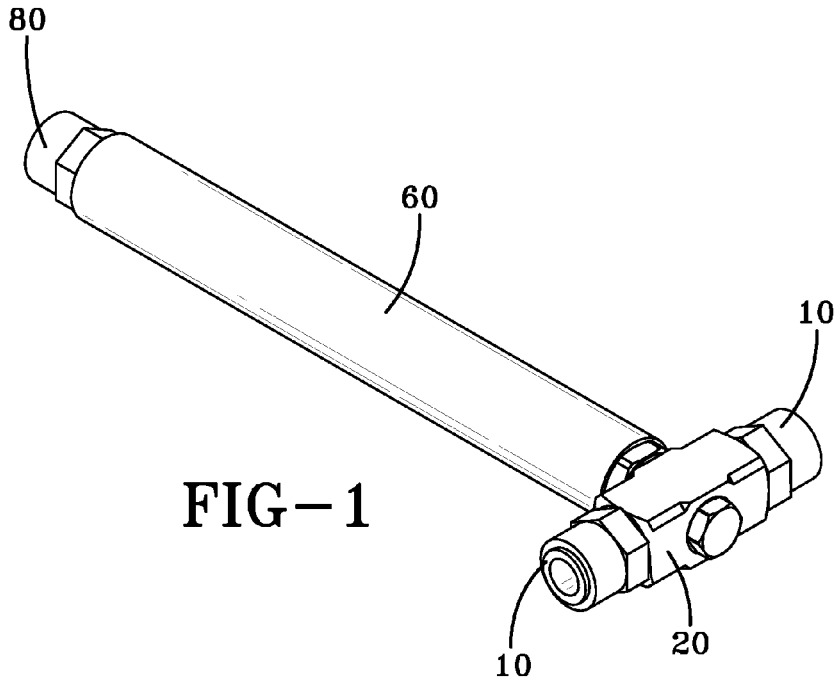
FIG. 1 is a perspective view of an embodiment of the compact continuous water carbonation system.

Turning to the drawings for a better understanding, FIG. 1 shows a perspective view of an embodiment of the assembled apparatus. It can be appreciated from this depiction that the apparatus is not as bulky or complicated as conventional carbonation apparatuses.

FIG. 1 is a perspective view of an embodiment of a compact continuous water carbonation system. FIG. 1 displays several of the components of the system including the optional fluid passage adapters 10, the manifold assembly 20, at the inlet end of a mixing chamber 60, and the optional outlet adapter 80 at the outlet end of the mixing chamber.

Figure 2:
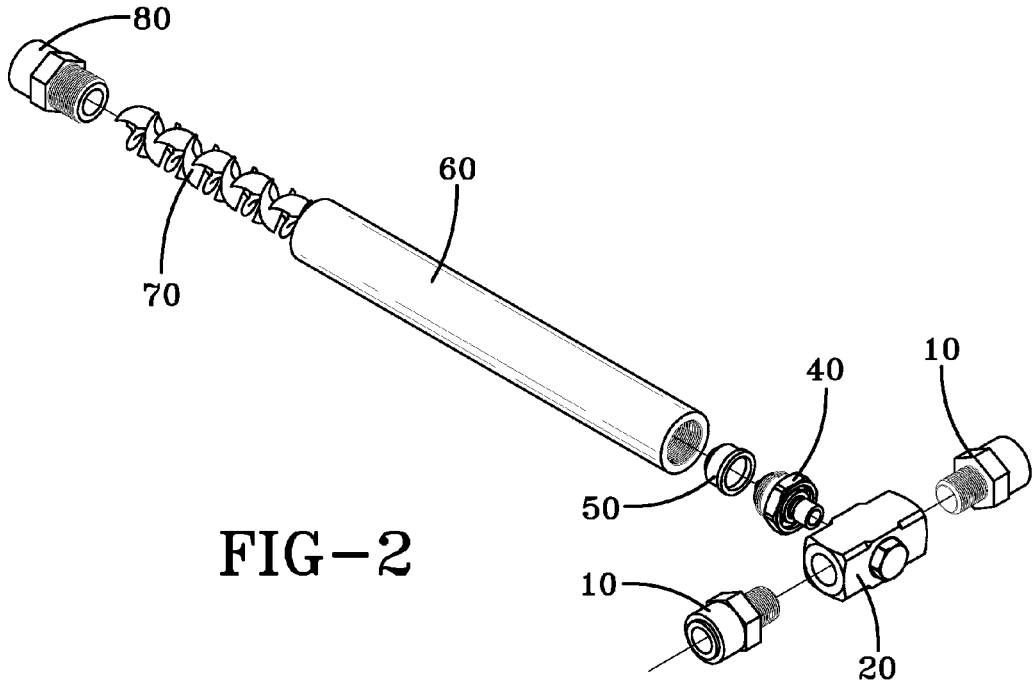
FIG. 2 is an exploded version of FIG. 1.

FIG. 2 is an exploded view of the embodiment introduced in FIG. 1. It can be appreciated from FIG. 2 that this embodiment of the apparatus can be disassembled into a relatively small number of necessary parts. As seen from FIG. 2, the compact continuous water carbonation system may include fluid passage adapters 10, in communication with the manifold assembly 20. Additionally, FIG. 2 includes an illustration of the relative positions of the first fluid cap 40, the second fluid cap 50, the mixing chamber 60, the mixer 70, and the outlet adapter 80, in an embodiment of the compact continuous water carbonation system. All of the components listed above may be made from common materials used in fluid or beverage handling or delivery, including but not limited to plastics, metals or ceramics. The most pressing requirement for the components is that the material be compatible with the fluid that is to be passed through it.

The static mixer 70 may be of any of the common types of static mixers used for mixing multiple fluids. Typical static mixers are composed of a series of baffles or vanes disposed about a central axis. Static mixers are used to mix two fluids streams. Generally, as the streams of fluids pass along the static mixer, the flows are divided each time they encounter a stationary element of the static mixer, creating a laminar or turbulent flow across the leading edge of each element (vane or baffle). Typical static mixers may be purchased from, for example, Koflo Corporation of Cary, Ill. As stated above, the static mixer may be made from materials common to the beverage industry such as metals, ceramics or plastics.

Figure 3:
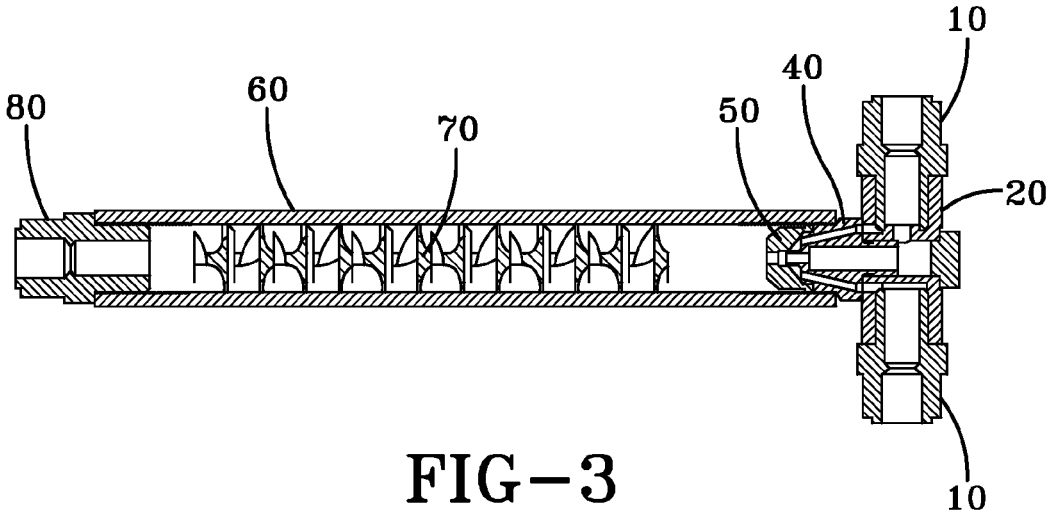
FIG. 3 is a cross-section plan view of the embodiment illustrated in FIG. 1.

FIG. 3 is a cross-section of an embodiment of the compact continuous water carbonation system. The mixer 70 may be positioned substantially in the center of the mixing chamber 60 so long a sufficient distance is provided for atomization and interaction of the fluids after they pass through the fluid caps 40 and 50.

Figure 4:
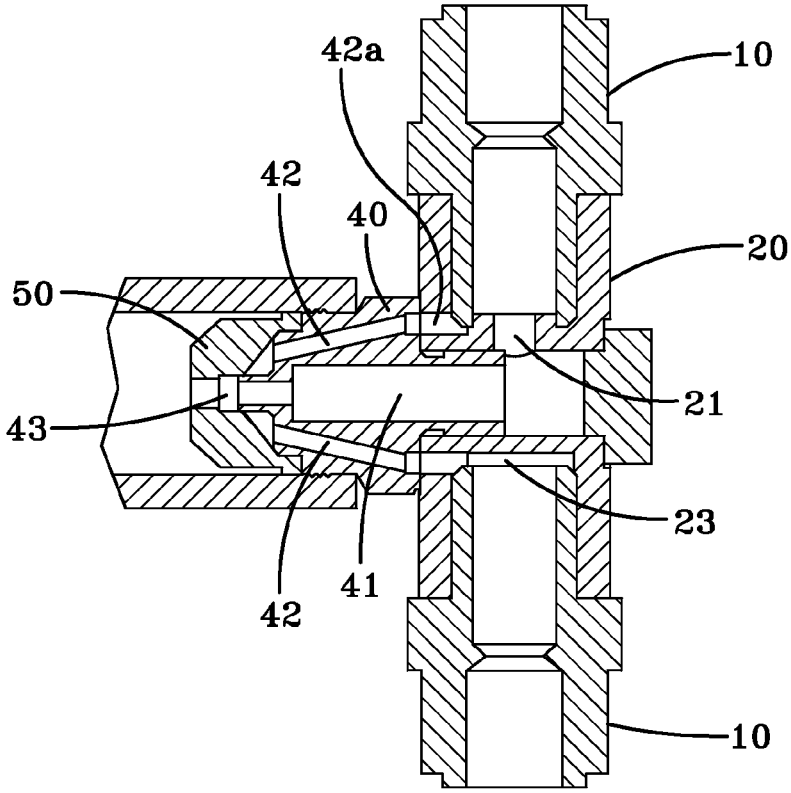
FIG. 4 is an enlarged view of a portion of FIG. 3, highlighting the manifold assembly, the first and second fluid caps, and the fluid passage adapters.

FIG. 4 is a magnified view of an embodiment of the cross-section view of FIG. 3 and it illustrates the relationship between the optional fluid passage adapters 10 and the manifold assembly 20. The manifold assembly includes a first fluid inlet channel 21, and a second fluid inlet channel 23. The fluid passage adapters are removably connected to the manifold assembly. It can be appreciated from FIGS. 3 and 4 that manifold assembly 20 allows for a different pathway for each of the fluids that are delivered to the manifold assembly. In the embodiment depicted in FIG. 3 and FIG. 4, a first fluid passage adapter 10 delivers a fluid to the inlet end of the first fluid inlet channel 21, and a second fluid passage adapter 10 delivers a fluid to the inlet end second fluid inlet channel 23. As illustrated by FIG. 3 and FIG. 4, the manifold assembly allow for both the first and second fluids to communicate with a first fluid cap 40.

In an embodiment of the compact continuous water carbonation system the first fluid cap 40 includes a first fluid channel 41, a second fluid distribution channel 42, and a second fluid channel 42*a*. The first fluid channel 41 may pass substantially through the center of the first fluid cap. The diameter of the first fluid channel 41 becomes smaller as the first fluid passes through the first fluid channel 41 before exiting through the first fluid exit 43.

Figure 5:
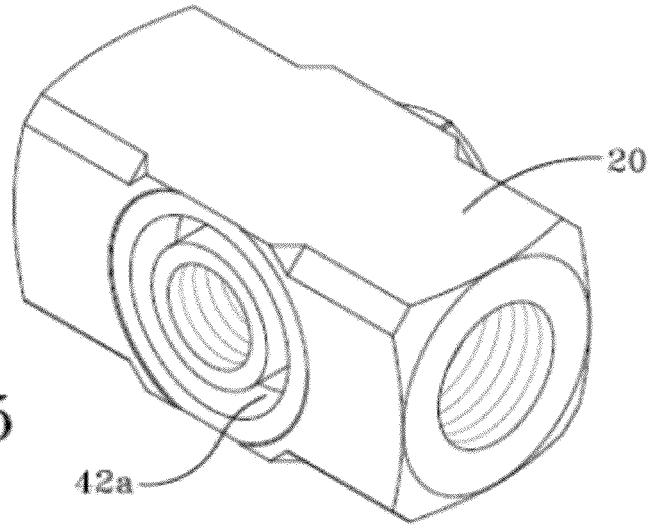
FIG. 5 is a perspective view of a manifold assembly much like that illustrated in FIG. 1.
Figure 6:
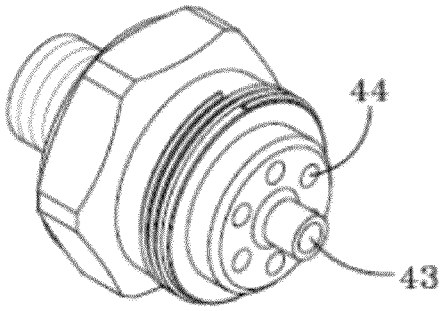
FIG. 6 is a perspective view of the first fluid cap illustrated in FIG. 2.
Figure 7:
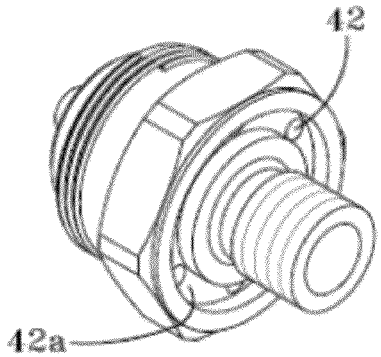
FIG. 7 is a rotated perspective view of the first fluid cap of FIG. 6.
Figure 8:
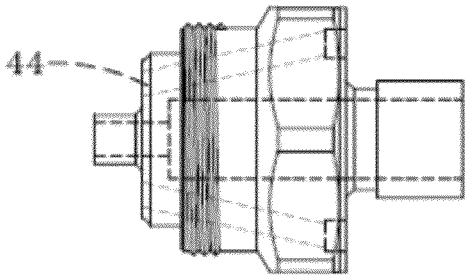
FIG. 8 is a plan view of the first fluid cap illustrated in FIGS. 6 and 7.

As may be appreciated from FIGS. 5 and 7, when mated with the manifold assembly, the first fluid cap and the manifold assembly create a second fluid distribution channel 42 for the passage of the second fluid. The second fluid distribution channel 42 is substantially annular in shape and arranged about the first fluid channel 41. The first fluid cap portion of the second fluid distribution channel 42 may be seen upon inspection of FIG. 7. FIG. 6 illustrates the arrangement of the at least one second fluid exit 44, and the first fluid exit 43 in an embodiment of the compact continuous water carbonation system. The second fluid distribution channel 42, allows the second fluid to distribute among the at least one second fluid channel 42*a*. FIG. 8 illustrates that the at least one second fluid channel is angled such that upon passing through the at least one second fluid exit 44, the second fluid is directed substantially at the flow of the first fluid as it exits from the first fluid exit 43. The result of this arrangement is that if one of the fluids is a gas and the other is a liquid, the forces generated by the gas passing about the liquid flow will create an atomized spray-effect and generate a very small average diameter droplet.

It should be noted that the atomized spray effect generated is much more efficient at mixing the fluids than, for example, venturi-type mixing technology. Venturi technology generates a zone of reduced pressure by increasing the speed of the first fluid; the reduced pressure then draws the second fluid into the first fluid stream, however, the interaction of the first and second fluids in a venturi-type apparatus is still bulk mixing, that is the interaction is not as complete as in atomized mixing. The result is that the compact continuous water carbonation system produces much higher carbonation levels as well as a longer-lasting solubilization of the carbon dioxide in the water, and a correspondingly better, and more pleasing, carbonated beverage. This is due to the small droplets of the liquid more effectively interacting with the gas due to the tremendous amount of surface area, and shear forces generated; thus allowing for improved absorption of the gas in the liquid.

Figure 9:
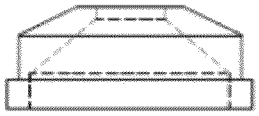
FIG. 9 is an illustration of a second fluid cap, more specifically, an external second fluid cap.
Figure 10:
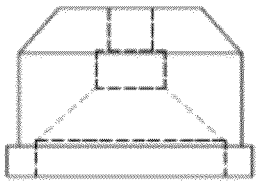
FIG. 10 is an alternative embodiment of a second fluid cap, an internal second fluid cap.

An embodiment of the compact continuous carbonation system also includes a second fluid cap 50. Alternative embodiments of the second fluid cap are depicted in detail in FIG. 9 and FIG. 10. FIG. 9 shows an embodiment of an external second fluid cap, and FIG. 10 shows an embodiment of an internal second fluid cap. The second fluid cap may be removably connected to the first fluid cap 40. The second fluid cap generally provides a constricted space for interaction of the first fluid with the second fluid for increased spray production, and corresponding increased fluid interaction. FIG. 4 illustrates an embodiment of the interaction of the first fluid cap 40 with an internal second fluid cap 50. It can be appreciated from FIG. 4 that once the second fluid leaves the at least one second fluid exit 44, it is directed towards the first fluid exit 43. This arrangement will create a tremendous amount of shear force on the first fluid by the passage of the second fluid across the flow of the first fluid, thus creating very small droplets of a spray of the first fluid. Alternatively, an external second fluid cap may be employed. The external second fluid cap creates very much the same shear forces on the fluids. Both the first fluid cap 40, and the second fluid cap 50, may be comprised of common materials used in liquid and beverage handling including but not limited to plastics, ceramics and metals.

After the spray has been generated, it will travel beyond the second fluid cap 50, and into the mixing chamber 60. The mixing chamber 60 is an elongated tube which includes an inlet end in fluid communication with the manifold assembly 20, and the first and second fluid caps 40 and 50, and an outlet end in fluid communication with an outlet adapter 80. Additionally, the carbonated water leaving the outlet adapter 80 may be dispensed via a flow regulating device, of the kind commonly found in the beverage handling industry. In an embodiment the mixing chamber 60, is removably connected to the first fluid cap 40. Additionally, the mixing chamber may be removably connected to the outlet adapter 80. The mixing chamber may be comprised of common materials used in liquid and beverage handling including but not limited to plastics, ceramics and metals. Additionally, the mixing chamber 60 may be comprised of either rigid or flexible materials.

In an embodiment of the compact continuous carbonation system, the apparatus also includes a mixer 70 in the mixing chamber 60. The mixer may be a static mixer comprising a series of baffles or vanes traversing the length of the mixing chamber, as may be appreciated from FIG. 2 and FIG. 3. Alternatively, the static mixer may be a spiral mixer or of any other design aimed at creating an environment for the optimal mixing of two fluids.

In an embodiment of the compact continuous carbonation system, the apparatus also includes an outlet adapter 80. The outlet adapter is removably connected to and is in fluid communication with the outlet end of the mixing chamber 60. The outlet may be comprised of common materials used in liquid and beverage handling including but not limited to plastics, ceramics and metals.

Figure 11:
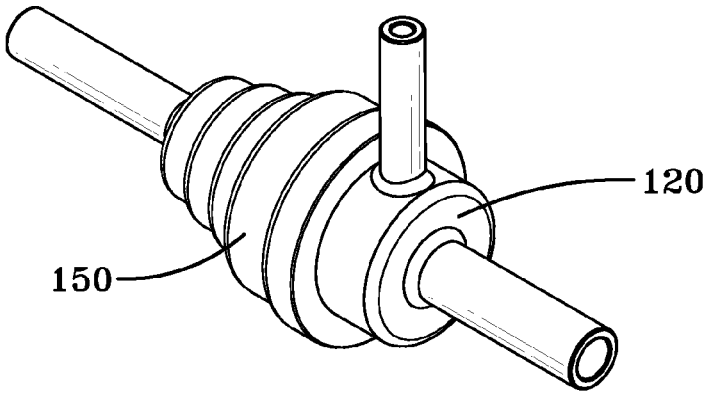
FIG. 11 is a perspective view of an assembled alternative embodiment of the compact and continuous water carbonation system.

FIG. 11 is an alternative embodiment of the manifold assembly 120, and the second fluid cap 150 of the compact continuous water carbonation system. Further embodiments of the manifold assembly 120 and the second fluid cap 150 can be appreciated from FIG. 11.

Figure 12:
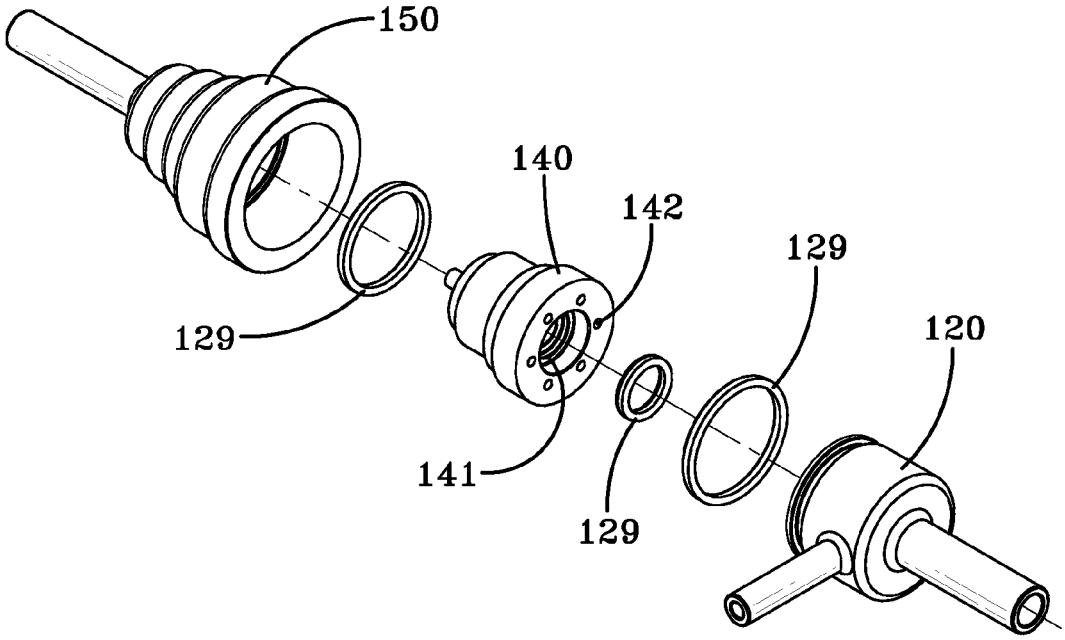
FIG. 12 is an exploded view of the system of FIG. 11.

FIG. 12 is an exploded view of the alternative embodiment of FIG. 11. FIG. 12 demonstrates how, in an alternative embodiment, the first fluid cap 140 may fit almost entirely within the second fluid cap 150 and the manifold assembly 120. It can be appreciated from FIGS. 12 and 13, that while the at least one second fluid channel 142*a* is similarly situated in this alternative embodiment, the second fluid distribution channel 142 may be incorporated substantially into the manifold assembly 120. Optional o-rings 129 are depicted in FIGS. 12 and 13, however, any common method for creating a substantially fluid-proof seal may be employed.

Figure 13:
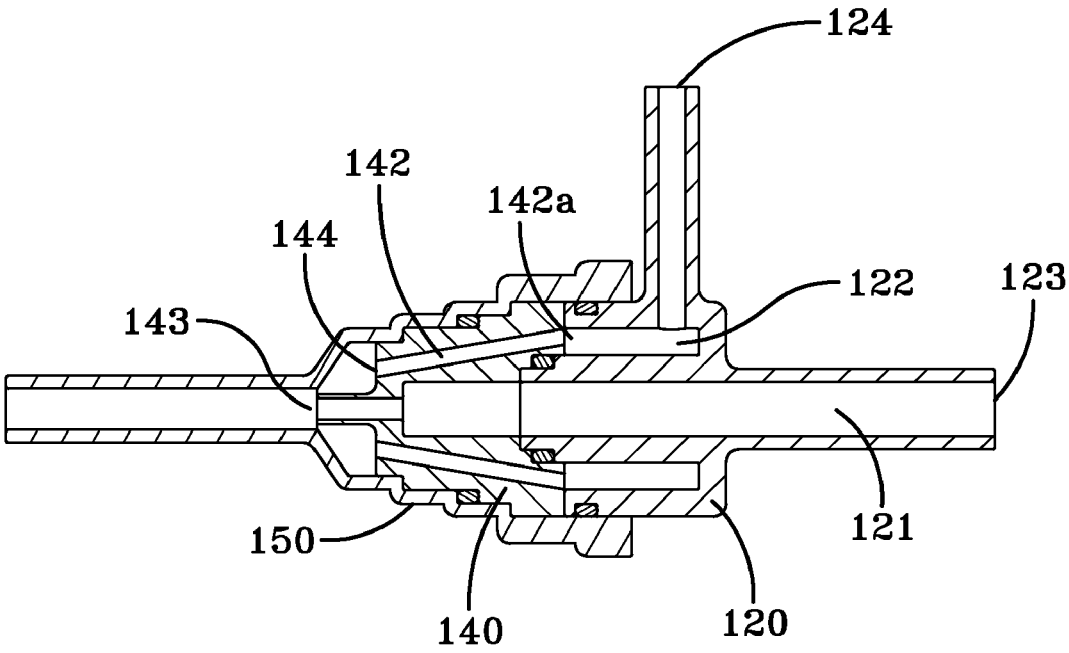
FIG. 13 is a cross-section view of an alternative embodiment of the embodiment illustrated in FIG. 11.

FIG. 13 is a cross-section view of an alternative embodiment of the manifold assembly 120, the first fluid cap 140, and the second fluid cap 150. The manifold assembly 120 includes a first fluid inlet channel 121, and a second fluid inlet channel 122, both in communication with the first fluid cap 140. A first fluid is delivered to the inlet end 123 of the first fluid inlet channel 121, and a second fluid is delivered to the inlet end 124 of the second fluid inlet channel 122. The first fluid inlet channel passes substantially through the center of the manifold assembly 120. The second fluid inlet channel 122 is similar to the second fluid inlet channel 23 of the previous embodiment in that the channel is substantially perpendicular to the path of the fluid as it enters the manifold assembly. Additionally, the manifold assembly includes a second fluid distribution channel 142 arranged about the first fluid inlet channel 121. In an embodiment, the second fluid distribution channel is substantially annular. The second fluid distribution channel 142, allows the second fluid to distribute among, and is in communication with the, at least one second fluid channels 142*a*. The first fluid passes through the first fluid channel 141 of the first fluid cap 140, and subsequently out the first fluid exit 143. The second fluid passes through the at least one second fluid channels 142*a*, and out the at least one second fluid exit 144. The at least one second fluid channel is angled such that upon passing through the at least one second fluid exit 144, the second fluid is directed substantially at the flow of the first fluid as it exits from the first fluid exit 143. The result of this arrangement is that if one of the fluids is a gas and the other is a liquid, the forces generated by the gas passing about the liquid flow will create an atomized spray-effect and generate a very small average diameter droplet and a highly effective interaction between the two fluids leading to a pleasingly carbonated beverage.

An embodiment of the compact continuous carbonation system also includes a second fluid cap 150. The second fluid cap generally provides a constricted space for interaction of the first fluid with the second fluid for increased spray production, and corresponding increased fluid interaction. The embodiment of FIG. 13 shows an external second fluid cap 150. The interaction of the two fluids in the embodiment of FIG. 13 will be substantially similar to that described for the previous embodiment. Additionally, the components depicted in FIGS. 11, 12, and 13 may be comprised of common materials used in fluid or beverage handling or delivery, including but not limited to plastics, metals or ceramics. The most pressing requirement for the components is that the material be compatible with the fluid that is to be passed through it.

Having shown and described an embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for dissolving a gas in a liquid, comprising:

an elongated mixing chamber defining a longitudinal axis and having an inlet end and an outlet end;

a manifold assembly at the inlet end of the mixing chamber;

wherein the manifold assembly is in fluid communication with the inlet end of the mixing chamber; and a first fluid cap in communication with the manifold assembly; wherein the first fluid cap includes a first fluid channel traversing the length of the first fluid cap, and in communication with the first fluid inlet channel of the manifold assembly;

the first fluid cap and the manifold define a second fluid distribution channel, which is in communication with the second fluid inlet channel of the manifold assembly;

the first fluid cap also includes at least one second fluid channel substantially traversing the length of the first fluid cap; and in communication with the second fluid distribution channel.

2. The apparatus of claim 1, wherein the manifold assembly comprises:

a first fluid inlet channel including an inlet end and an outlet end;

a second fluid inlet channel including an inlet end and an outlet end.

3. The apparatus of claim 1, further comprising an outlet adapter at the outlet end of the mixing chamber.

4. The apparatus of claim 1, further comprising at least one mixing means.

5. The apparatus of claim 4, wherein at least one mixing means is contained in the mixing chamber.

6. The apparatus of claim 5, wherein the mixing means is a static mixer including at least one mixing vane or baffle.

7. The apparatus of claim 1, wherein the at least one second fluid channel is angled from the second fluid distribution channel towards the outlet of the first fluid channel.

8. The apparatus of claim 7, further comprising a second fluid cap.

9. The apparatus of claim 8, wherein the second fluid cap directs the flow of the second fluid into the stream of the first fluid, causing an atomized spray to be generated.

10. The apparatus of claim 2, further comprising an outlet adapter at the outlet end of the mixing chamber.

11. The apparatus of claim 10, further comprising at least one mixing means contained in the mixing chamber.

12. The apparatus of claim 11, wherein the mixing means is a static mixer including at least one mixing vane or baffle.

13. The apparatus of claim 2, further comprising a second fluid cap.

14. The apparatus of 13, wherein the second fluid cap directs the flow of the second fluid into the stream of the first fluid, causing an atomized spray to be generated.

* * * * *